US009175683B2

(12) United States Patent
Unami et al.

(10) Patent No.: US 9,175,683 B2
(45) Date of Patent: Nov. 3, 2015

(54) DOUBLE ROTATION TYPE SCROLL EXPANDER AND POWER GENERATION APPARATUS INCLUDING SAME

(71) Applicant: ANEST IWATA CORPORATION, Yokohama-shi, Kanagawa-ken (JP)

(72) Inventors: Atsushi Unami, Yokohama (JP); Tamotsu Fujioka, Yokohama (JP); Kazuaki Sato, Yokohama (JP)

(73) Assignee: ANEST IWATA CORPORATION, Kanagawa-Ken (JP)

( * ) Notice: Subject to any disclaimer, the term of this patent is extended or adjusted under 35 U.S.C. 154(b) by 191 days.

(21) Appl. No.: 13/868,563

(22) Filed: Apr. 23, 2013

(65) Prior Publication Data

US 2013/0309116 A1 Nov. 21, 2013

(30) Foreign Application Priority Data

Apr. 25, 2012 (JP) ..... 2012-100022

(51) Int. Cl.

| | |
|---|---|
| ***F04C 18/00*** | (2006.01) |
| ***F04C 18/02*** | (2006.01) |
| ***F01C 1/02*** | (2006.01) |
| ***F01C 21/06*** | (2006.01) |

(52) U.S. Cl.

CPC ..... *F04C 18/00* (2013.01); *F01C 1/0238* (2013.01); *F01C 21/06* (2013.01); *F04C 18/0238* (2013.01); *F04C 2240/603* (2013.01)

(58) Field of Classification Search

CPC ..... F01C 1/023; F01C 1/0238; F04C 18/023; F04C 18/0238

USPC ..... 418/55.1–55.6, 57, 58, 60, 61.1, 188, 418/209

See application file for complete search history.

(56) References Cited

U.S. PATENT DOCUMENTS

| | | | | |
|---|---|---|---|---|
| 801,182 | A * | 10/1905 | Oreux | 418/142 |
| 4,192,152 | A * | 3/1980 | Armstrong et al. | 62/402 |
| 4,990,071 | A * | 2/1991 | Sugimoto | 418/55.2 |

(Continued)

FOREIGN PATENT DOCUMENTS

| | | | | |
|---|---|---|---|---|
| JP | 6341381 | A | 12/1994 | |
| JP | 06341381 | A * | 12/1994 | F04C 18/02 |

(Continued)

OTHER PUBLICATIONS

English Translation of JP H06-341381 (Dec. 1994).*

*Primary Examiner* — Thomas Denion
*Assistant Examiner* — Laert Dounis
(74) *Attorney, Agent, or Firm* — Hauptman Ham, LLP

(57) ABSTRACT

A double rotation type scroll expander that expands steam includes a first drive scroll, a second drive scroll, a driven scroll, a rotation mechanism that supports the driven scroll rotatably, and a revolving mechanism that couples the driven scroll to the first drive scroll and the second drive scroll to be capable of revolving relative thereto. The revolving mechanism includes: a plurality of metal revolving pins provided respectively between a first drive end plate of the first drive scroll and a first driven arm of the rotation mechanism and between a second drive end plate of the second drive scroll and a second driven arm of the rotation mechanism; and a plurality of metal revolving discs provided in relation to the respective revolving pins and disposed such that respectively corresponding revolving pins are coupled thereto eccentrically.

4 Claims, 2 Drawing Sheets

(56) References Cited

U.S. PATENT DOCUMENTS

| | | | | |
|---|---|---|---|---|
| 5,024,589 | A * | 6/1991 | Jetzer et al. | 418/55.3 |
| 5,318,425 | A * | 6/1994 | Jetzer et al. | 418/55.6 |
| 6,953,330 | B1 * | 10/2005 | Muto | 418/60 |
| 7,124,585 | B2 * | 10/2006 | Kim et al. | 60/643 |
| 2006/0216180 | A1 * | 9/2006 | Yanagisawa et al. | 418/55.2 |
| 2007/0212245 | A1 * | 9/2007 | Tsuchiya | 418/55.3 |

FOREIGN PATENT DOCUMENTS

| | | | | |
|---|---|---|---|---|
| JP | 2003269101 | A * | 9/2003 | F01C 1/02 |
| JP | 2009209706 | A | 9/2009 | |

* cited by examiner

DOUBLE ROTATION TYPE SCROLL EXPANDER AND POWER GENERATION APPARATUS INCLUDING SAME

RELATED APPLICATIONS

The present application is based on, and claims priority from, Japanese Application Number JP 2012-100022, filed Apr. 25, 2012, the disclosure of which is hereby incorporated by reference herein in its entirety.

BACKGROUND OF THE INVENTION

1. Field of the Invention

The present invention relates to a double rotation type double wrap scroll expander in which two drive scrolls and a driven scroll rotate synchronously, and a power generation apparatus including this scroll expander.

2. Description of the Related Art

Conventional power generation systems tend mostly to be large scale plants generating at least several hundred kW, while small scale power generation is performed mostly by simply structured engine power generators and the like. Recently, however, due to increased awareness of the need for energy conservation, passage of the Act on Special Measures Concerning Procurement of Renewable Electric Energy by Operators of Electric Utilities, and the like, a need and a market for small scale power generation are gradually increasing.

Under these circumstances, photovoltaic generation and wind force power generation are not sufficiently cost-effective, and further improvements are required to reach a level at which general use is feasible.

Japanese Patent Application Publication No. 2009-209706, meanwhile, discloses a binary power generation system exhibiting relatively favorable cost-effectiveness. This binary power generation system includes a scroll expander and a power generator, and is configured such that a working medium having a low boiling point is pressurized to high pressure using hot water or steam at 85 to 150° C. as a heat source, whereupon the working medium is expanded by the scroll expander in order to drive the small scale power generator.

Here, a scroll expander exhibits little torque variation and is therefore suitable for use in a small scale power generation system. In a scroll expander having a fixed scroll and a drive scroll, however, the drive scroll slidingly contacts with the stationary fixed scroll, and therefore a dynamic seal is required, making it difficult to secure a favorable sealing property. Further, a thrust load is exerted on the drive scroll, and therefore a bearing that supports the drive scroll rotatably is easily damaged.

A scroll fluid apparatus disclosed in Japanese Patent Application Publication No. H6-341381, on the other hand, is a double rotation type double wrap scroll fluid machine. With this type of scroll fluid machine, a favorable sealing property is obtained and the thrust load is reduced, leading to improved reliability.

More specifically, a double rotation type scroll fluid machine includes a drive scroll and a driven scroll, wherein the drive scroll and the driven scroll rotate synchronously. Hence, a dynamic seal is not required, and therefore a favorable sealing property can be secured. Further, when a double wrap scroll fluid machine is used as an expander, expansion chambers exist on both sides of the driven scroll, and therefore a thrust load exerted on the drive scroll and the driven scroll is reduced by being canceled out.

SUMMARY OF THE INVENTION

In the scroll fluid machine disclosed in Japanese Patent Application Publication No. H6-341381, an Oldham ring is used as a revolving mechanism that causes the driven scroll to revolve relative to the drive scroll. However, an Oldham ring is typically made of resin, and therefore has low heat resistance. Hence, when a load is exerted on the Oldham ring in a high-temperature water vapor environment, the Oldham ring deforms. When high-temperature water vapor is expanded by a scroll expander using an Oldham ring, therefore, the revolving motion of the driven scroll may be obstructed by the deformation of the Oldham ring, possibly leading to a reduction in output or a breakdown.

The present invention has been designed in consideration of these problems in the prior art, and an object thereof is to provide a double rotation type scroll expander having high heat resistance, and a power generation apparatus including the double rotation type scroll expander.

To achieve this object, according to an aspect of the present invention, a double rotation type scroll expander that expands steam includes: a housing having an inflow hole into which the steam flows, a first end wall provided with a first shaft hole, and a second end wall provided with a second shaft hole that is coaxial with the first shaft hole; a first drive shaft that extends so as to penetrate the first shaft hole and has an inner end within the housing; a first drive bearing provided between the housing and the first drive shaft; a second drive shaft that is provided in the housing coaxially with the first drive shaft such that a part thereof is disposed inside the second shaft hole, and that includes a second inner end removed from a first inner end of the first drive shaft, and a connecting hole opened in the second inner end so as to communicate with the inflow hole; a second drive bearing provided between the housing and the second drive shaft; a first drive scroll including a first drive endplate coupled to the first inner end of the first drive shaft, and a first drive wrap projecting from an opposite side of the first drive end plate to the first drive shaft; a second drive scroll including a second drive end plate that is coupled to the second inner end of the second drive shaft and includes a drive through hole communicating with the connecting hole, and a second drive wrap projecting from an opposite side of the second drive end plate to the second drive shaft;

a driven scroll that includes a driven end plate disposed between the first drive wrap and the second drive wrap and provided with a driven through hole in a center thereof, and driven wraps projecting from respective surfaces of the driven end plate, and that forms an expansion chamber for expanding the steam on each side of the driven end plate in cooperation with the first drive scroll and the second drive scroll; a drive coupling member that couples the first drive scroll and the second drive scroll to each other integrally and rotatably; a rotation mechanism that includes a first driven boss and a second driven boss respectively disposed to surround the first drive shaft and the second drive shaft eccentrically to the first drive shaft and the second drive shaft, a first driven arm and a second driven arm extending respectively from the first driven boss and the second driven boss in respective radial directions of the first driven boss and the second driven boss, a first driven coupling member and a second driven coupling member respectively coupling the first driven arm to the driven scroll and the second driven arm to the driven scroll, and a first driven bearing and a second driven bearing provided respectively between the housing and the first driven boss and between the housing and the second driven boss, whereby the rotation mechanism supports the driven scroll rotatably; and a revolving mechanism that includes a plurality of metal revolving pins provided respectively between the first drive end plate and the first driven arm and between the second drive end plate and the second driven arm, and a plurality of metal revolving discs provided in relation to the respective revolving pins and disposed such that respectively corresponding revolving pins are coupled thereto eccentrically, whereby the revolving mechanism couples the driven scroll to the first drive scroll and couples the driven scroll to the second drive scroll to be capable of revolving relative thereto.

In the double rotation type scroll expander according to this aspect, the revolving pins and revolving discs of the revolving mechanism are made of metal and therefore highly heat-resistant. Hence, the double rotation type scroll expander has a long lifespan even when used to expand water vapor, for example. Further, the driven scroll revolves smoothly relative to the first drive scroll and the second drive scroll, and therefore a rotary force output to the outside from the first drive shaft is increased.

Moreover, in this double rotation type scroll expander, the revolving pins couple the first drive scroll to the first driven arm and the second drive scroll to the second driven arm to be capable of a relative revolving motion. In other words, the revolving mechanism is provided on both the first drive scroll side and the second drive scroll side. The driven scroll is guided by the revolving mechanism on each side so as to revolve smoothly relative to the first drive scroll and the second drive scroll, whereby the rotary force output to the outside from the first drive shaft is increased.

Furthermore, in this double rotation type scroll expander, the expansion chamber is provided on both sides of the driven end plate of the driven scroll, and therefore an amount of inflowing steam can be increased, whereby the output rotary force can be increased, and a thrust load can be prevented from acting on the rotation mechanism and the revolving mechanism.

The double rotation type scroll expander described above may further include an adiabatic layer provided between the second drive bearing and an inner peripheral surface of the connecting hole.

According to this configuration, even when high-temperature steam flows through the connecting hole provided in the second drive shaft, a flow of heat from the connecting hole to the second drive bearing is impeded by the adiabatic layer, and therefore an increase in a temperature of the second drive bearing is suppressed, whereby a reliability of the second drive bearing is improved, leading to a further increase in the lifespan of the double rotation type scroll expander.

Further, to achieve the aforesaid object, according to an aspect of the present invention, a power generation apparatus includes: the double rotation type scroll expander described above; and a power generator coupled to the first drive shaft.

The double rotation type scroll expander used in this power generation apparatus exhibits great durability even when used to expand water vapor, for example, and generates a large output. Hence, the power generation apparatus can generate power efficiently using steam from water or the like, and is therefore highly cost-effective.

The present invention provides a double rotation type scroll expander having high heat resistance, and a power generation apparatus that includes this double rotation type scroll expander.

DESCRIPTION OF THE PREFERRED EMBODIMENTS

An embodiment of the present invention will be described in detail below with reference to the drawings. Note, however, that unless specific description is provided to the contrary, dimensions, materials, shapes, relative arrangements, and the like of constituent components described in the embodiment are not intended to limit the scope of the present invention.

Figure 1:
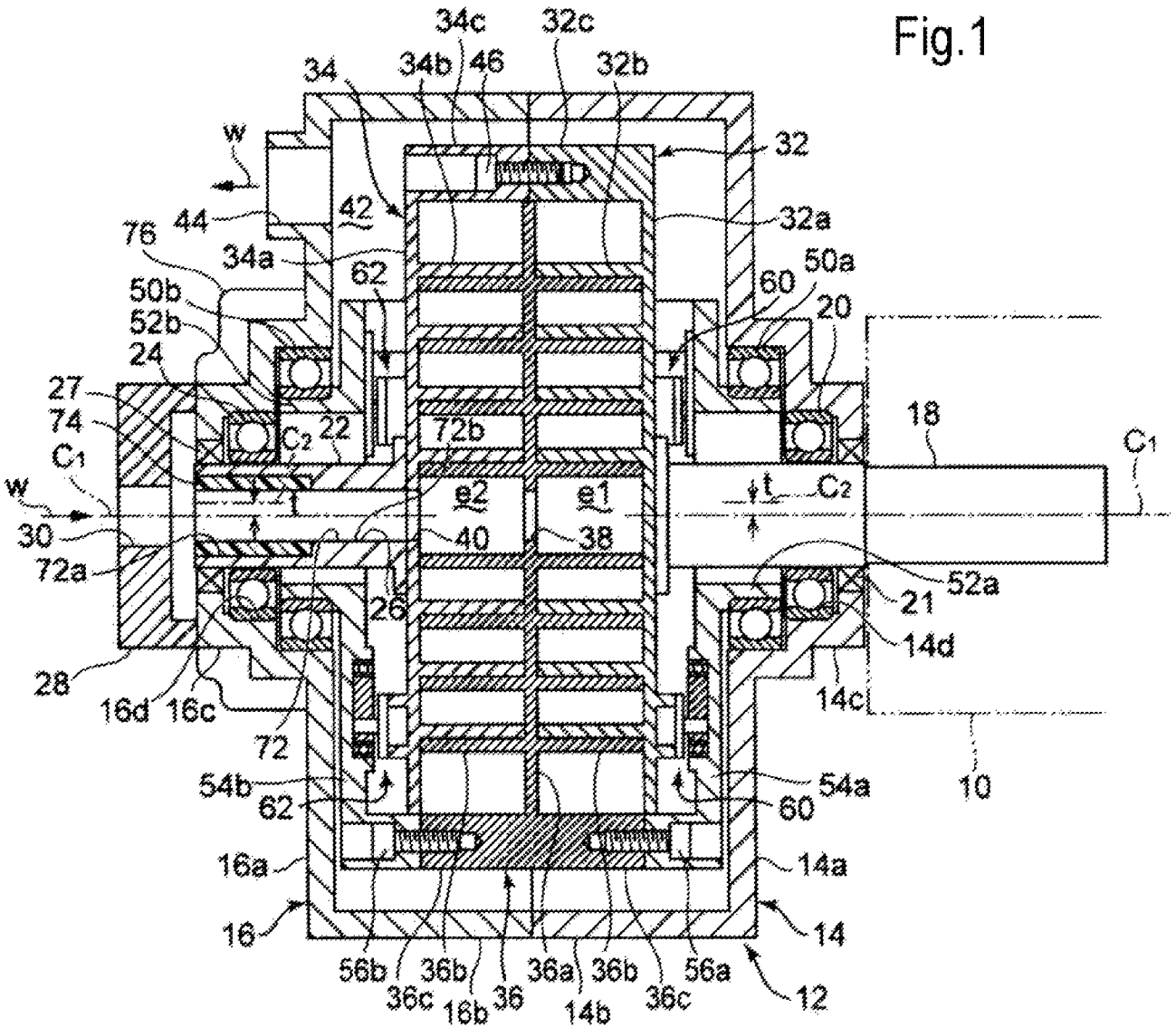
FIG. 1 is a schematic longitudinal sectional view of a scroll expander according to an embodiment of the present invention.

FIG. 1 is a schematic longitudinal sectional view of a scroll expander according to an embodiment. The scroll expander is a double rotation type double wrap scroll expander that outputs a rotary force by expanding a high-pressure working medium w. The scroll expander is capable of expanding water, a refrigerant, and the like as the working medium w, and is therefore suitable for expanding high-temperature steam. The scroll expander is particularly suitable for expanding high-temperature water vapor having a temperature of approximately 170° C. to 180° C., for example. The water vapor may be superheated steam or saturated steam. The scroll expander is connected to a power generator 10 shown by a dot-dot-dash line in FIG. 1, and together with the power generator 10 constitutes a power generation apparatus. In the power generation apparatus, the scroll expander drives the power generator 10 using the working medium w as a power source, thereby causing the power generator 10 to generate power.

The scroll expander includes a substantially cylindrical housing 12, and the housing 12 is constituted by a first casing 14 and a second casing 16. The first casing 14 and the second casing 16 include, respectively, a first end wall 14*a* and a second end wall 16*a*, which are substantially circular, and a first peripheral wall 14*b* and a second peripheral wall 16*b*, which are substantially cylindrical and formed integrally with the first end wall 14*a* and the second end wall 16*a*, respectively. Respective tip ends of the first peripheral wall 14*b* and the second peripheral wall 16*b* are connected to each other in an airtight fashion such that a hollow space is defined inside the housing 12 by the first casing 14 and the second casing 16.

Stepped cylindrical portions 14*c*, 16*c* are provided integrally in respective centers of the first end wall 14*a* and the second end wall 16*a*, and the cylindrical portions 14*c*, 16*c* respectively define a first shaft hole 14*d* and a second shaft hole 16*d* penetrating the first end wall 14*a* and the second end wall 16*a*.

A first drive shaft 18 is provided to penetrate the first shaft hole 14*d*. The first drive shaft 18 is supported by a first drive bearing 20, disposed between the first drive shaft 18 and the cylindrical portion 14*c*, to be capable of rotating about an axis $C_1$ of the first drive shaft 18 and the first drive bearing 20. The first drive shaft 18 includes an inner end (a first inner end) positioned inside the housing 12 and an outer end positioned outside the housing 12, and the power generator 10 is connected to the outer end of the first drive shaft 18.

A sealing member 21 is disposed in a gap between an inner peripheral surface of an outer end of the cylindrical portion 14*c* and an outer peripheral surface of the first drive shaft 18, and the gap is made airtight by the sealing member 21.

A second drive shaft 22 is provided coaxially with the first drive shaft 18. The second drive shaft 22 extends through the inside of the housing 12, and includes an inner end (a second inner end) positioned on the first drive shaft 18 side and an outer end positioned inside the cylindrical portion 16*c*. The second drive shaft 22 is supported rotatably by a second drive bearing 24 disposed between the second drive shaft 22 and the cylindrical portion 16*c*. The second drive bearing 24 is disposed coaxially with the first drive bearing 20 such that, similarly to the first drive shaft 18, the second drive shaft 22 is supported to be capable of rotating about the axis $C_1$.

A connecting hole 26 is formed in the second drive shaft 22. The connecting hole 26 penetrates a radial direction central portion of the second drive shaft 22 in an axial direction, and opens onto an inner end surface and an outer end surface of the second drive shaft 22.

A sealing member 27 is disposed in a gap between an inner peripheral surface of an outer end of the cylindrical portion 16*c* and an outer peripheral surface of the second drive shaft 22, and the gap is made airtight by the sealing member 27.

A cover 28 is attached to the outer end of the cylindrical portion 16*c* in an airtight fashion, and an inflow hole 30 is formed in a center of the cover 28. The inflow hole 30 penetrates the cover 28, and is disposed coaxially with the connecting hole 26. The cover 28 forms a part of the housing 12 together with the first casing 14 and the second casing 16.

A first drive scroll 32, a second drive scroll 34, and a driven scroll 36 are disposed between the inner end of the first drive shaft 18 and the inner end of the second drive shaft 22.

The first drive scroll 32 and the second drive scroll 34 respectively include a first drive endplate 32*a* and a second drive endplate 34*a*, which are substantially circular. The inner end of the first drive shaft 18 and the inner end of the second drive shaft 22 are fixed integrally and rotatably to respective centers of the first drive endplate 32*a* and the second drive endplate 34*a*. Note that respective normal directions of the first drive endplate 32*a* and the second drive end plate 34*a* are parallel to the axis $C_1$.

A first drive wrap 32*b* and a second drive wrap 34*b* are respectively provided integrally with the first drive end plate 32*a* and the second drive end plate 34*a*. The first drive wrap 32*b* projects integrally from an inner surface of the first drive end plate 32*a* on an opposite side to the first drive shaft 18, while the second drive wrap 34*b* projects integrally from an inner surface of the second drive endplate 34*a* on an opposite side to the second drive shaft 22.

In other words, the first drive end plate 32*a* and the second drive end plate 34*a* oppose each other via a predetermined interval, and the first drive wrap 32*b* projects from the first drive end plate 32*a* toward the second drive end plate 34*a* while the second drive wrap 34*b* projects from the second drive end plate 34*a* toward the first drive end plate 32*a*. A tip end of the first drive wrap 32*b* and a tip end of the second drive wrap 34*b* are separated from each other by a predetermined interval.

The driven scroll 36 includes a substantially circular driven end plate 36*a*. The driven end plate 36*a* is positioned between the tip end of the first drive wrap 32*b* and the tip end of the second drive wrap 34*b* such that the tip end of the first drive wrap 32*b* and the tip end of the second drive wrap 34*b* slidingly contact with respective surfaces of the driven end plate 36*a*.

Driven wraps 36*b* project integrally from the respective surfaces of the driven end plate 36*a*, and tip ends of the driven wraps 36*b* are respectively in sliding contact with the inner surface of the first drive end plate 32*a* and the inner surface of the second drive end plate 34*a*.

When seen from the axial direction of the first drive shaft 18 and second drive shaft 22, the first drive wrap 32*b*, the second drive wrap 34*b*, and the driven wraps 36*b* have a spiral, or in other words an involute, planar shape, and are disposed such that the first drive wrap 32*b* intermeshes with the driven wrap 36*b* and the second drive wrap 34*b* intermeshes with the driven wrap 36*b*.

The first drive wrap 32*b* and the second drive wrap 34*b* have an identical spiral shape, and therefore overlap each other when seen from the axial direction of the first drive shaft 18. Similarly, the driven wraps 36*b* on the respective sides of the driven end plate 36*a* have an identical spiral shape, and therefore overlap each other when seen from the axial direction of the first drive shaft 18.

As a result, a first expansion chamber e1 is formed between the first drive scroll 32 and the driven scroll 36, and a second expansion chamber e2 is formed between the second drive scroll 34 and the driven scroll 36. In other words, the first drive scroll 32, the second drive scroll 34, and the driven scroll 36 cooperate with each other to form the first expansion chamber e1 and the second expansion chamber e2 on respective sides of the driven end plate 36*a*.

Capacities of the first expansion chamber e1 and the second expansion chamber e2 are at a minimum when the first expansion chamber e1 and the second expansion chamber e2 are positioned in a radial direction center of the driven end plate 36*a*, and increase gradually as the first expansion chamber e1 and the second expansion chamber e2 are respectively divided into two crescent-shaped pockets so as to extend outward in the radial direction of the driven end plate 36*a* along an inner surface and an outer surface of the driven wraps 36*b*.

A driven through hole 38 is formed in the center of the driven end plate 36*a* coaxially with the second drive shaft 22. The first expansion chamber e1 and the second expansion chamber e2 communicate with each other via the driven through hole 38 when positioned on the axis $C_1$ of the second drive shaft 22, or in other words when positioned centrally in the radial direction of the driven end plate 36*a*.

Further, a drive through hole 40 is formed in a center of the second drive end plate 34*a* coaxially with the second drive shaft 22, and the driven through hole 40 communicates with the connecting hole 26. Hence, the second expansion chamber e2 communicates with the inflow hole 30 via the connecting hole 26 and the drive through hole 40 when positioned centrally in a radial direction of the second drive end plate 34*a*. At this time, the first expansion chamber e1 is positioned centrally in the radial direction of the driven end plate 36*a* so as to communicate with the second expansion chamber e2 via the driven through hole 38, and therefore communicates with the inflow hole 30 via the second expansion chamber e2.

Upon reaching an outer peripheral portion of the driven end plate 36*a*, the first expansion chamber e1 and the second expansion chamber e2 communicate with a surrounding space 42 surrounding the first drive scroll 32, the second drive scroll 34, and the driven scroll 36 within the housing 12.

An outflow hole 44 is formed in the second end wall 16*a* of the second casing 16, and the surrounding space 42 communicates with the exterior of the housing 12 via the outflow hole 44.

A first outer peripheral portion 32*c* and a second outer peripheral portion 34*c* of the first drive wrap 32*b* and the second drive wrap 34*b*, which are positioned on respective outer peripheral sides of the first drive scroll 32 and the second drive scroll 34, are formed to be thicker than inner peripheral sides. The first outer peripheral portion 32*c* and the second outer peripheral portion 34*c* are coupled to each other by a drive coupling screw 46. The drive coupling screw 46 is a coupling member that couples the first drive scroll 32 and the second drive scroll 34 to each other integrally and rotatably.

As a result, the first drive shaft 18, the first drive scroll 32, the second drive scroll 34, and the second drive shaft 22 are coupled integrally and coaxially, and supported rotatably on both sides by the first drive bearing 20 and the second drive bearing 24 sandwiching the first drive scroll 32 and the second drive scroll 34.

The driven scroll 36 is capable of rotating synchronously with the first drive scroll 32 and the second drive scroll 34, but a rotation center of the driven scroll 36 is removed from a rotation center of the first drive shaft 18 and the second drive shaft 22 by a predetermined distance in the radial direction of the driven end plate 36*a*.

The driven scroll 36 is also capable of revolving relative to the first drive scroll 32 and the second drive scroll 34 while rotating synchronously with the first drive scroll 32 and second drive scroll 34.

More specifically, a rotation mechanism that supports the driven scroll 36 to be capable of synchronous rotation includes a first rotation unit and a second rotation unit sandwiching the driven scroll 36.

The first rotation unit includes a first driven bearing 50*a*, a first driven boss 52*a*, a first driven arm 54*a*, and a first driven coupling screw 56*a*, while the second rotation unit includes a second driven bearing 50*b*, a second driven boss 52*b*, a second driven arm 54*b*, and a second driven coupling screw 56*b*.

The first driven boss 52*a* and the second driven boss 52*b* take a cylindrical shape and are surrounded respectively by the cylindrical portion 14*c* and the cylindrical portion 16*c*. The first driven bearing 50*a* and the second driven bearing 50*b*, which are constituted by roller bearings, are disposed respectively between the first driven boss 52*a* and the cylindrical portion 14*c* and between the second driven boss 52*b* and the cylindrical portion 16*c*. The first driven bearing 50*a* and the second driven bearing 50*b* are disposed coaxially.

Hence, the first driven boss 52*a* and the second driven boss 52*b* are supported by the first driven bearing 50*a* and the second driven bearing 50*b* to be capable of rotating about an axis $C_2$ of the first driven bearing 50*a* and the second driven bearing 50*b*. The axis $C_2$ is parallel to the axis $C_1$ but removed from the axis $C_1$ by a predetermined distance (an eccentricity amount) t.

The first driven arm 54*a* and the second driven arm 54*b* are provided integrally with the first driven boss 52*a* and the second driven boss 52*b*, respectively, so as to extend from the first driven boss 52*a* and the second driven boss 52*b* outward in a radial direction.

Outer peripheral portions 36*c* of the respective driven wraps 36*b*, which are positioned on an outer peripheral side of the driven scroll 36, are formed to be thicker than an inner peripheral side. The outer peripheral portions 36*c* are coupled to the first driven arm 54*a* and the second driven arm 54*b*, respectively, by the first driven coupling screw 56*a* and the second driven coupling screw 56*b*. In other words, the first driven coupling screw 56*a* is a coupling member that couples the first driven arm. 54*a* to the driven scroll 36 integrally and rotatably, while the second driven coupling screw 56*b* is a coupling member that couples the second driven arm 54*b* to the driven scroll 36 integrally and rotatably.

Further, a revolving mechanism that causes the driven scroll 36 to revolve relative to the first drive scroll 32 and the second drive scroll 34 includes a plurality of first revolving units 60 provided between the first drive scroll 32 and the first rotation unit and a plurality of second revolving units 62 provided between the second drive scroll 34 and the second rotation unit. For example, three first revolving units 60 are provided at equal circumferential direction intervals around the first drive shaft 18, and three second revolving units 62 are provided at equal circumferential direction intervals around the second drive shaft 22.

Figure 2:
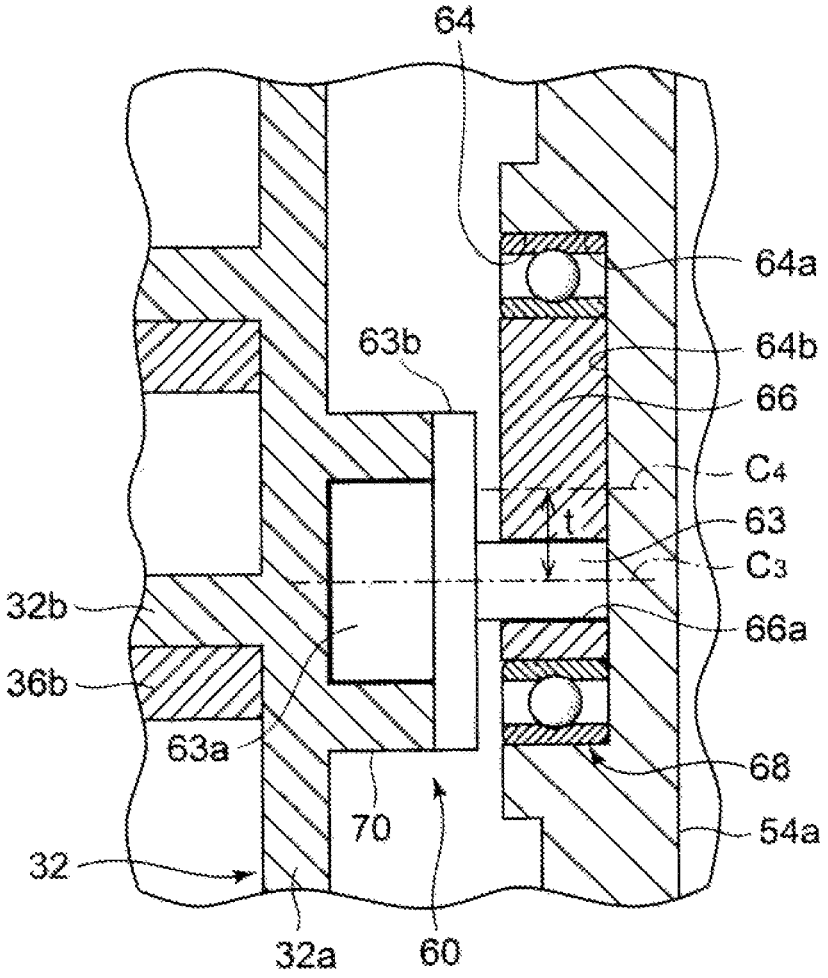
FIG. 2 is a partially enlarged view showing an enlargement of a revolving mechanism shown in FIG. 1.

FIG. 2 shows an enlargement of one of the first revolving units 60 shown in FIG. 1. The first revolving unit 60 includes a metal columnar revolving pin 63. An axis $C_3$ of the revolving pin 63 extends in parallel with the axis $C_1$ of the first drive shaft 18.

Meanwhile, a cylindrical recess 64 that opens onto the first drive end plate 32*a* is formed in the driven arm 54*a* of the first rotation unit, and the recess 64 is defined by a cylindrical peripheral surface 64*a* and an end surface 64*b*. A disc-shaped revolving disc 66 is disposed in the recess 64 concentrically therewith, and a thickness of the revolving disc 66 is approximately identical to a depth of the recess 64. A revolving bearing 68 constituted by a metal roller bearing is disposed between an outer peripheral surface of the revolving disc 66 and the peripheral surface 64*a* of the recess 64. The revolving disc 66 is capable of rotating within the recess 64 about an axis $C_4$ passing through a center thereof, which is parallel to the axis $C_1$ of the first drive shaft 18.

A pin insertion hole 66*a* is provided in the revolving disc 66, and the pin insertion hole 66*a* penetrates the revolving disc 66 in a thickness direction in a position removed from the axis $C_4$ in the radial direction. One end of the revolving pin 63 on the driven arm 54*a* side is press-fitted into the pin insertion hole 66*a* such that the revolving pin 63 is coupled eccentrically to the revolving disc 66 provided in relation to the revolving pin 63. When the revolving disc 66 rotates, the revolving pin 63 revolves about the axis $C_4$ of the revolving disc 66.

Meanwhile, a cylindrical boss portion 70 that opens toward the driven arm. 54*a* is formed integrally with the first drive end plate 32*a*. Another end of the revolving pin 63 on the first drive end plate 32*a* side is formed as a large-diameter end portion 63*a* having a larger diameter than the one end side, and a collar portion 63*b* is formed integrally with the revolving pin 63 adjacent to the large-diameter end portion 63*a*.

The large-diameter end portion 63*a* of the revolving pin 63 is press-fitted into the boss portion 70 such that the collar portion 63*b* contacts a tip end of the boss portion 70, whereby the revolving pin 63 is fixed integrally to the boss portion 70. Thus, the boss portion 70 is capable of revolving about the axis $C_4$ of the revolving disc 66, whereby the driven scroll 36 is capable of revolving relative to the first drive scroll 32.

The axis $C_3$ of the revolving pin 63 is parallel to the axis $C_4$ of the revolving disc 66 but removed from the axis $C_4$ by a predetermined distance (an eccentricity amount) t. The eccentricity amount t of the axis $C_4$ from the axis $C_3$ is identical to the eccentricity amount t of the axis $C_2$ from the axis $C_1$.

The second revolving unit, apart from being provided between the second drive end plate 34*a* and the second driven arm 54*b*, is configured identically to the first revolving unit, and therefore description of the second revolving unit has been omitted.

Further, in a preferred aspect of this embodiment, an adiabatic layer is provided between the inner peripheral surface of the connecting hole 26, which serves as a flow passage for the working medium w, and the second drive bearing 24.

More specifically, a stepped axial direction through hole 72 is formed in the second drive shaft 22 such that the second drive shaft 22 has a large diameter inner peripheral surface 72*a* on the outer end side and a small diameter inner peripheral surface 72*b* on the inner end side. A cylindrical sleeve 74 made of resin, for example, is fitted/fixed to the large diameter inner peripheral surface 72*a* integrally and concentrically, and a thickness of a wall of the sleeve 74 is equal to a difference between radii of the large diameter inner peripheral surface 72*a* and the small diameter inner peripheral surface 72*b*.

Hence, the inner peripheral surface of the connecting hole 26 is formed from an inner peripheral surface of the sleeve 74 and the small diameter inner peripheral surface 72*b* of the axial direction through hole 72, which together form a continuous surface not having a step, and the sleeve 74 functions as the adiabatic layer between the inner peripheral surface of the connecting hole 26 and the second drive bearing 24.

In another preferred aspect of this embodiment, a plurality of radiator plates 76 are provided integrally with the outer peripheral surface of the cylindrical portion 16*c*. The radiator plates 76 are disposed in a radial fashion around the cylindrical portion 16*c*.

An operation of the scroll expander described above will now be described.

High-temperature, high-pressure superheated steam serving as the working medium w flows into the second expansion chamber e2 through the inflow hole 30 and via the connecting hole 26 and the drive through hole 40, and then flows into the first expansion chamber e1 via the driven through hole 38. A temperature of the superheated steam when flowing through the inflow hole 30 is between 170° C. and 180° C., for example.

The first drive scroll 32, the second drive scroll 34, and the driven scroll 36 are caused to move in conjunction by a pressure (an expansion force) of the working medium w such that the capacities of the first expansion chamber e1 and the second expansion chamber e2 increase.

More specifically, the first drive scroll 32 and the second drive scroll 34 rotate about the axis $C_1$ of the first drive shaft 18 and second drive shaft 22. For each revolution of the first drive scroll 32 and the second drive scroll 34, the driven scroll 36 rotates once about the axis $C_2$ of the first driven boss 52*a* and second driven boss 52*b* and revolves once about the axis $C_4$ of the revolving disc 66.

As the capacities of the first expansion chamber e1 and the second expansion chamber e2 increase, the first expansion chamber e1 and the second expansion chamber e2 move outward when seen from the radial direction of the driven end plate 36*a*. The first expansion chamber e1 and the second expansion chamber e2 eventually communicate with the surrounding space 42 such that the expanded low-pressure working medium w in the first expansion chamber e1 and the second expansion chamber e2 flows out to the exterior of the housing 12 through the surrounding space 42 and the outflow hole 44. In the meantime, a rotary force of the first drive shaft 18, generated by the expansion force of the working medium w in the first expansion chamber e1 and the second expansion chamber e2, is input into the power generator 10, whereby the power generator 10 generates power.

In the scroll expander according to the embodiment described above, the revolving pins 63 and the revolving discs 66 of the revolving mechanism are made of metal and therefore highly heat-resistant. Hence, the scroll expander has a long lifespan even when used to expand superheated steam. Further, the driven scroll 36 revolves smoothly relative to the first drive scroll 32 and the second drive scroll 34, and therefore the rotary force output to the outside from the first drive shaft 18 is increased.

Moreover, in the scroll expander described above, the revolving pins 63 couple the first drive scroll 32 to the first driven arm 54*a* and the second drive scroll 34 to the second driven arm 54*b* to be capable of a relative revolving motion. In other words, the revolving mechanism is provided on both the first drive scroll 32 side and the second drive scroll 34 side. The driven scroll 36 is guided by the revolving mechanism on each side so as to revolve smoothly relative to the first drive scroll 32 and the second drive scroll 34, whereby the rotary force output to the outside from the first drive shaft 18 is increased.

Furthermore, in this scroll expander, the first expansion chamber e1 and the second expansion chamber e2 are provided on the respective sides of the driven end plate 36*a* of the driven scroll 36, and therefore an amount of inflowing superheated steam can be increased, whereby the output rotary force can be increased, and a thrust load can be prevented from acting on the rotation mechanism and the revolving mechanism.

Further, with this scroll expander, the driven scroll 36 revolves smoothly relative to the first drive scroll 32 and the second drive scroll 34, and therefore gaps between the driven scroll 36 and the first drive scroll 32 and second drive scroll 34 can be kept extremely small at all times, whereby the scroll expander can be made oil free, and in this case, oil can be prevented from intermixing with the working medium w.

Moreover, in a preferred aspect of this embodiment, the adiabatic layer is provided so that even when the high-temperature superheated steam flows through the connecting hole 26 provided in the second drive shaft 22, a flow of heat from the connecting hole 26 to the second drive bearing 24 can be impeded by the adiabatic layer. Hence, an increase in the temperature of the second drive bearing 24 can be suppressed, thereby preventing the second drive bearing 24 and grease sealed in the interior of the second drive bearing 24 from deteriorating, and therefore a shortening of the lifespan of the second drive bearing 24 and the grease can be prevented, whereby a reliability of the second drive bearing 24 is improved, and the lifespan of the scroll expander is increased even further.

Furthermore, in this embodiment, the adiabatic layer is formed from the sleeve 74 fitted to the large diameter inner peripheral surface 72*a* of the through hole 72, and no step exists between the inner peripheral surface of the sleeve 74 and the small diameter inner peripheral surface 72*b*, whereby the working medium w flows smoothly through the connecting hole 26.

Moreover, in a preferred aspect of this embodiment, the radiator plates 76 are provided around the cylindrical portion 16*c* so that the heat of the cylindrical portion 16*c* is discharged to the outside efficiently. Likewise in this case, an increase in the temperature of the second drive bearing 24, which is disposed on an inner side of the cylindrical portion 16*c*, can be suppressed, leading to an improvement in the reliability of the second drive bearing 24 and a further increase in the lifespan of the scroll expander.

In the power generation apparatus including the scroll expander according to this embodiment, the scroll expander exhibits great durability even when used to expand high-temperature water vapor, and generates a large output. Hence, the power generation apparatus can generate power efficiently using high-temperature water vapor, and is therefore highly cost-effective.

The present invention is not limited to the embodiment described above, and includes embodiments obtained by amending the above embodiment.

For example, the sleeve 74 serving as the adiabatic layer may be provided over an entire region of the connecting hole 26. Further, a fluororesin such as polytetrafluoroethylene or another type of engineering plastic may be used as a material of the sleeve 74. Alternatively, a different type of metal from the second drive shaft 22 may be used. Moreover, a metallic cylindrical collar may be fitted to all or a part of an outer peripheral region of the second drive shaft 22 as the adiabatic layer.

On the other hand, as long as durability can be secured in the second drive bearing 24, the adiabatic layer and the radiator plates 76 do not necessarily have to be provided.

Furthermore, in the scroll expander, two members coupled to each other integrally may be constituted by a single, integrally molded member. Alternatively, an integrally molded member may couple separate members to each other.

The present invention provides a double rotation type double wrap scroll expander having high heat resistance, and a power generation apparatus including the scroll expander.

What is claimed is:

1. A double rotation type scroll expander configured to expand steam, the double rotation type scroll expander comprising:

a housing having an inflow hole into which the steam is flowable, a first end wall including a first shaft hole, and a second end wall including a second shaft hole that is coaxial with the first shaft hole;

a first drive shaft configured to extend so as to penetrate the first shaft hole and having an inner end within the housing;

a first drive bearing provided between the housing and the first drive shaft;

a second drive shaft provided in the housing coaxially with the first drive shaft such that a part thereof is disposed inside the second shaft hole, and including a second inner end removed from a first inner end of the first drive shaft, and a connecting hole opened in the second inner end so as to communicate with the inflow hole;

a second drive bearing between the housing and the second drive shaft;

a first drive scroll including a first drive end plate coupled to the first inner end of the first drive shaft, and a first drive wrap projecting from an opposite side of the first drive end plate to the first drive shaft;

a second drive scroll including a second drive end plate coupled to the second inner end of the second drive shaft and including a drive through hole communicating with the connecting hole, and a second drive wrap projecting from an opposite side of the second drive end plate to the second drive shaft;

a driven scroll including a driven end plate disposed between the first drive wrap and the second drive wrap and including a driven through hole in a center thereof, and driven wraps projecting from respective surfaces of the driven end plate, and forming an expansion chamber for expanding the steam on each side of the driven end plate in cooperation with the first drive scroll and the second drive scroll;

a drive coupling member that couples the first drive scroll and the second drive scroll to each other integrally and rotatably, for the driven scroll to revolve relative to the first drive scroll and the second drive scroll such that a rotary force output to the outside from the first drive shaft is increased;

a rotation mechanism including a first driven boss and a second driven boss respectively disposed to surround the first drive shaft and the second drive shaft eccentrically to the first drive shaft and the second drive shaft, a first driven arm and a second driven arm extending respectively from the first driven boss and the second driven boss in respective radial directions of the first driven boss and the second driven boss, a first driven coupling member and a second driven coupling member respectively coupling the first driven arm to the driven scroll and the second driven arm to the driven scroll, and a first driven bearing and a second driven bearing provided respectively between the housing and the first driven boss and between the housing and the second driven boss, in a manner that the rotation mechanism supports the driven scroll rotatably; and a revolving mechanism including a plurality of metal revolving pins provided respectively between the first drive end plate and the first driven arm and between the second drive end plate and the second driven arm, and a plurality of metal revolving discs provided in relation to the respective revolving pins and disposed such that respectively corresponding revolving pins are coupled thereto eccentrically, in a manner that the revolving mechanism couples the driven scroll to the first drive scroll and couples the driven scroll to the second drive scroll to be capable of revolving relative thereto.

2. The double rotation type scroll expander according to claim 1, further comprising an adiabatic layer between the second drive bearing and an inner peripheral surface of the connecting hole.

3. A power generation apparatus, comprising:

the double rotation type scroll expander according to claim 1; and a power generator coupled to the first drive shaft.

4. The power generation apparatus according to claim 3, wherein the double rotation type scroll expander further comprises an adiabatic layer between the second drive bearing and an inner peripheral surface of the connecting hole.

* * * * *